United States Patent [19]

Emmerich

[11] Patent Number: 4,632,195

[45] Date of Patent: Dec. 30, 1986

[54] ROOF DRILL SYSTEM

[75] Inventor: Kenneth C. Emmerich, Lexington, Ky.

[73] Assignee: Fansteel Inc., Chicago, Ill.

[21] Appl. No.: 740,574

[22] Filed: Jun. 3, 1985

[51] Int. Cl.[4] ..... E21B 17/00

[52] U.S. Cl. ..... 175/320; 279/103; 403/348; 403/383

[58] Field of Search ..... 175/320, 323; 279/19.3, 279/103; 403/348, 349, 359, 383; 173/104, 105; 464/18, 901

[56] References Cited

U.S. PATENT DOCUMENTS

| | | | |
|---|---|---|---|
| 1,593,561 | 7/1926 | Bayles | 279/19.3 |
| 3,187,825 | 6/1965 | Bower, Jr. | 175/320 |
| 4,099,585 | 7/1978 | Emmerich | 175/320 |
| 4,189,013 | 2/1980 | Adams et al. | 175/320 |
| 4,454,922 | 6/1984 | Jamison et al. | 175/320 |
| 4,532,672 | 8/1985 | Anderson | 403/349 |

*Primary Examiner*—James A. Leppink
*Assistant Examiner*—William P. Neuder
*Attorney, Agent, or Firm*—Barnes, Kisselle, Raisch, Choate, Whittemore & Hulbert

[57] ABSTRACT

An automatic drive lock drill system for roof drilling with a bit and drill steel components which are assembled axially one by one in telescoping relationship when the acircular drive shank on one part is inserted into an acircular recess in an adjacent part. The drive shank on each component has a series of radial lobes on the corners of the acircular part which are spaced at a set location from the end of the shank and will fit into the recess grooves and undercut ribs of the adjoining part and when rotated in either drive or reverse direction, each lobe of each male shank will automatically interlock on an axial plane, when rotated from an insertion orientation to a drive orientation.

7 Claims, 12 Drawing Figures

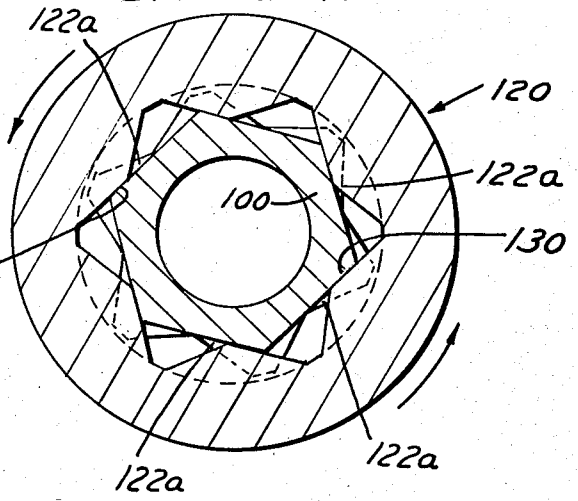
FIG. 8
DRIVE LOCK
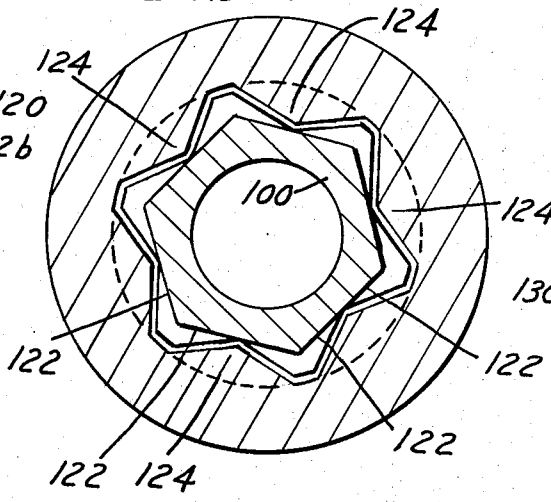
FIG. 7
LOAD UNLOAD
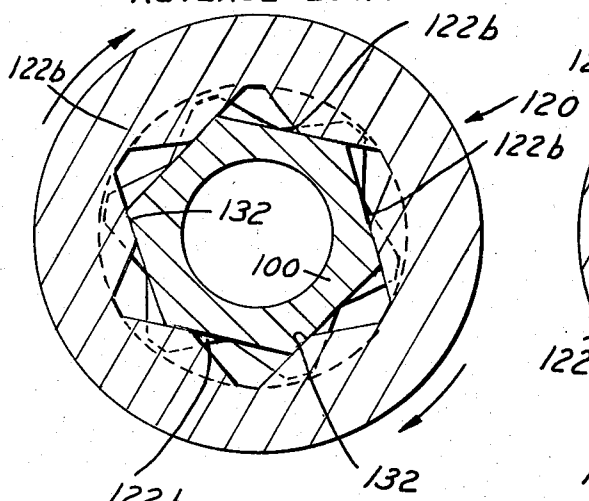
FIG. 9
REVERSE LOCK
FIG. 11
DRIVE LOCK
FIG. 10
LOAD-UNLOAD
FIG. 12
REVERSE LOCK

ROOF DRILL SYSTEM

FIELD OF INVENTION

A drilling system including mining drill heads and connected driving drill steels to mount the drill head and receive the driving torque from a rotating power source.

BACKGROUND AND OBJECTS OF THE INVENTION

Roof drilling in mines is a common procedure to provide holes for roof bolts which penetrate the overhead material in a mine and reinforce it against collapse. A full discussion of the use of roof drilling and roof bolts is found in a U.S. Pat. No. 4,226,290 issued to L. H. McSweeney on Oct. 7, 1980. Other United States patents directed to the same problem in mining are those issued to Liebee, U.S. Pat. No. 3,519,091, on July 7, 1970 and to Jamison, U.S. Pat. No. 4,454,922, on June 19, 1984.

All of the above patents are directed to means for holding and driving the rotating roof drill bits and also the connecting steels, that is, the elongate shafts which must be added as the hole progresses into the mine roof. The low overhead available requires, often, that the driving shafts be added as the hole gets deeper into the material being drilled. This elongate assembly or drill rod must be attached in such a way that the power drive can be efficiently transmitted to the bit and also in such a way that the driving steels can be removed once the hole has reached the proper depth. Another requirement of the bit drive is that it be hollow so that fluid or vacuum air above or below atmospheric pressure can be transmitted to remove the tailings and cool the bit.

The Liebee patent above identified discloses the use of hexagonal drive members and connections with frictional engagement from one member to the other. The Jamison patent discloses the use of helical interfitting members and sockets to effect the drive and restrain separation during removal of the assembled drill steels from the bore. The above-identified McSweeney patent discloses two connecting and retention systems. The first includes a drive socket with a separate cap which receives a drive end in one circumferential orientation and prevents withdrawal in a second circumferential orientation. The second retention system involves a groove in an inner telescoping part registering with a hole in an outer telescoping part so that a retention pin or wire can be driven into the groove through the hole to lock the parts against axial withdrawal.

It is an object of the present invention to provide an interlock system which will effectively drive the bit and drill steels in either direction and at the same time prevent axial separation of the bit and the various elements of the drive steel assembly, thus providing a system which affords effective protection for the operator when retracting the drill steel from each hole on an axial plane.

It is a further object to provide a roof bit drive rod assembly which involves only two parts for each drive chuck and each joint with no need for pins or wires or frictional elements and yet which provides a positive drive and axial interlock.

It is a further object to provide an interlock system which requires no special tools for assembly or disassembly and which can be readily assembled or disassembled.

A still further object is the provision of a drill steel and chuck system which will accept all existing conventional starters and drivers now in use.

It is frequent that an operator will operate a drill in one direction of rotation and then reverse the direction repeatedly especially when a hard rock condition is encountered. An object and feature of the present invention is the provision of a drive and joint connector which will provide axial engagement in either direction of rotation. Accordingly, the drill assembly may be placed under withdrawal tension when rotating in either direction.

A further object is the provision of a drill steel drive and assembly in which the parts are readily manufactured by conventional screw machines or forgings.

Other objects and features of the invention will be apparent in the following description and claims in which the invention is described together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as:

FIG. 7, a sectional view showing an hexagonal drive element in a load-unload orientation.

FIG. 8, a view as in FIG. 7 with the parts in counterclockwise drive orientation.

FIG. 9, a view as in FIG. 7 with the parts in clockwise drive position.

FIG. 10, a sectional view showing a square drive connection in load-unload orientation.

FIG. 11, a sectional view as in FIG. 10 with the parts in a counterclockwise drive rotation.

FIG. 12, a sectional view as in FIG. 10 with the parts in a clockwise drive position.

DETAILED DESCRIPTION OF THE INVENTION AND THE MANNER AND PROCESS OF USING IT

The invention is directed to a drive for roof drill assemblies in which the power driven chuck, the starter driver, the drill steel extension, and the bit or drill head are all connected to provide a rotary torque connection one to the other in either a clockwise or counterclockwise rotative direction. Secondly, the connection between the various elements of the elongate assembly is such that in a neutral orientation position, the parts may be readily separated axially. However, in either rotative position, clockwise or counterclockwise, the parts are axially interlocked so that the drill rod assembly may be tensioned as in a partial withdrawal or removal motion without disturbing the interlocking relationship.

Figure 1:
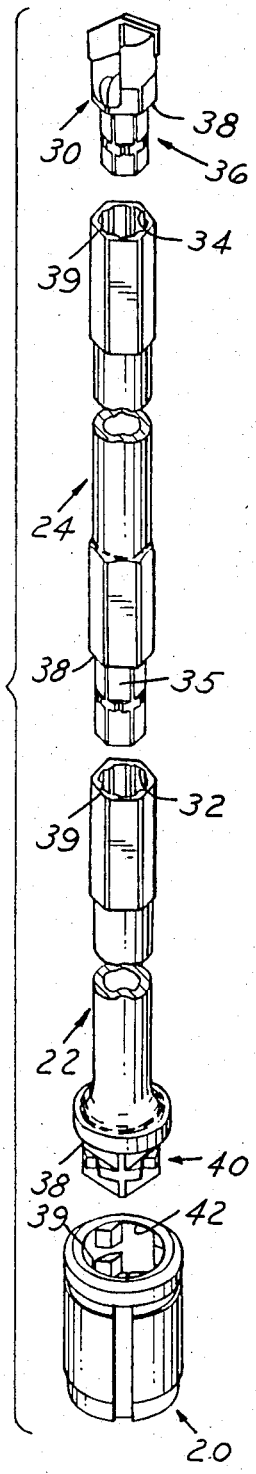
FIG. 1, an exploded perspective elevational view of a drill head bit and drill steel assembly with one chuck example.

With reference to the drawings, in FIG. 1, a drive assembly is illustrated with a power driven chuck 20 at the bottom of the view which is referred to in the trade as a LeeNorse chuck. The second element 22 is a starter driver and the third element 24 is a middle drive extension. It will be appreciated that roof drill bit 30 at the top of the figure will fit in the top end of the starter driver 22 as well as in the top end of the drive extension 24. Each element in the assembly is hollow to accept the flow of fluid or the vacuum air commonly used to remove tailings and cool the bit while it is operating.

The starter driver 22 and the drill extension 24 each have top recesses 32 and 34 respectively to receive the hexagonal male shank 36 of the bit 30. The middle drive extension has a lower male shank 35 to be received in the recess 32 of starter driver 22. The lower end of the starter driver has a square configuration 40 to be received in the recess 42 of the chuck 20.

Figure 2:
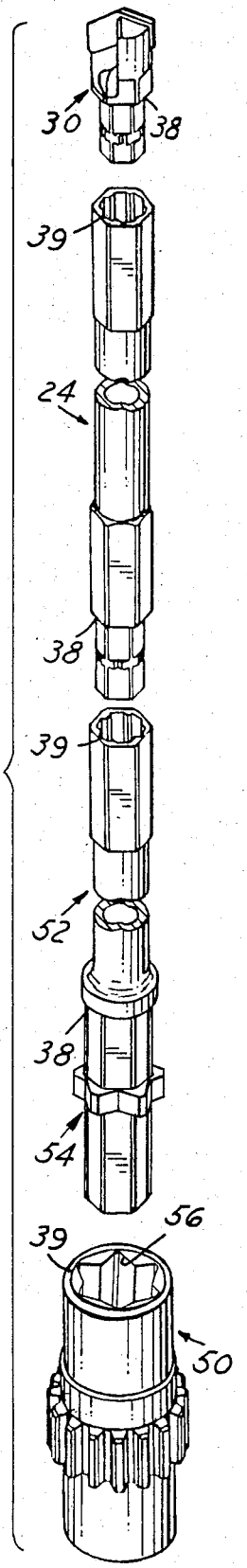
FIG. 2, an exploded perspective elevational view of a drill head bit and drill steel assembly with a second chuck example.

In FIG. 2, the top two elements, namely, the bit 30 and the drive extension 24, are the same as in FIG. 1. However, the bottom element 50 is a drive chuck referred to in the trade as a Galis deep socket chuck. The second element 52 is a starter driver having a relatively long hexagonal male drive shank 54 to be received in the recess 56 of the chuck 50.

Each drive shank, whether square or hexagonal, or any other polygonal shape, has axially extending surfaces which define a shank smaller than the maximum diameter of the element on which they are formed so that the shank terminates at a shoulder in a plane perpendicular to the axis of the part. For example, in FIGS. 1 and 2, these shoulders are found at 38. These shoulders cooperate with the ends of the peripheral wall surrounding the recesses which receive the shanks to transmit the axial thrust of thereof assembly toward the cutting bit. These peripheral bearing ends are shown at 39 in FIGS. 1 and 2.

The distinctive characteristic of the present invention lies, first, in the provision of circumferentially spaced lobes formed on the male insertion drive shanks of the bit drive assembly. The female recess or cavity of the drive assembly has either a quadaploidic or hexaploidic cross-sectional cavity to permit the lobed male shanks to enter. Nevertheless, these cavities can still receive the standard square or hexagonal male drive shanks so that standard drive steels will not be obsoleted by the present structure.

The second distinctive characteristic of the invention is in the formation of internal grooves spaces inwardly from the mouth of the receiving cavity and in a plane normal to the axis of the rotating parts. These grooves are formed such that, as the parts are turned relative to each other, the multiple lobes will be engaged axially to prevent disengagement of the parts but the corners of the square or hexagonal part are also circumferentially engaged to effect rotative driving engagement of the parts.

Figure 3:
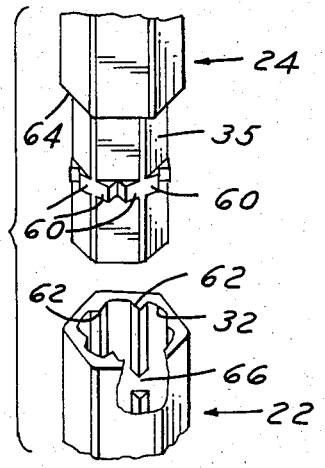
FIG. 3, an enlarged view of a hexagonal connection according to the present invention.

In FIG. 3, the lower hexagonal drive shank 35 of middle steel 24 is illustrated in relation to the modified hexagonal cavity 32 which can be termed a hexaploid cavity of starter driver 22. In addition to the hexagonal surfaces on the drive shank, corner lobes 60 are shown. In the cavity 32 of part 22, the inwardly projecting ribs 62 are grooved circumferentially at a location within the cavity an equal distance to the location of the lobes 60 from the shoulder 64 of shank 35. In FIG. 3, a groove 66 is shown in a breakaway view.

Figure 6:
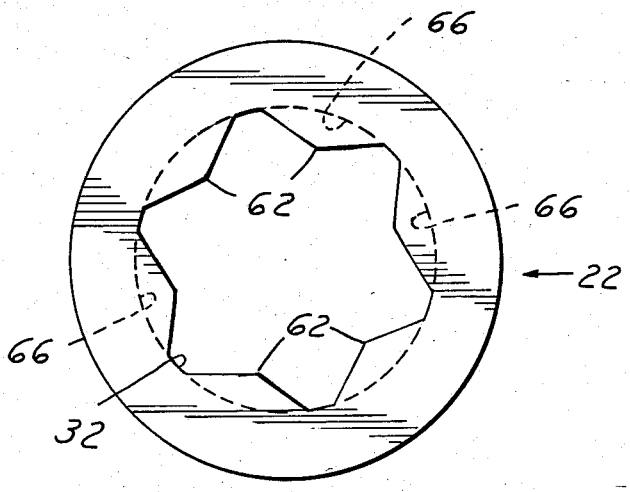
FIG. 6, a top view of a female socket end of a drill steel for an hexagonal male insert.

In FIG. 6, an enlarged end view of the hexaploid cavity 32 is illustrated. This cavity has six inwardly extending ribs 62. The dotted lines adjacent each rib designate the groove or undercut 66. Thus, the lobed shank 35 will enter the cavity 32; but when the parts are rotated relative to each other, the lobes will move under the ribs 62 into the undercuts 66 and interlock the parts 22 and 24 against disengagement.

Figure 4:
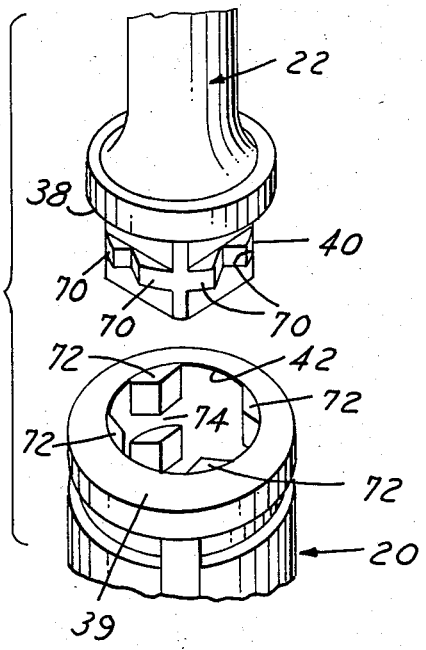
FIG. 4, an enlarged view of a square connection according to the present invention.

In FIG. 4, the lower square end 40 of starter driver 22 is shown enlarged from the view in FIG. 1, and the modified square recess 42, which may be termed a quadaploid cavity, in the chuck 20 is also illustrated. Here again, lobes 70 on the square shank are illustrated. In the cavity 42 of chuck 20 are ribs 72 which are undercut or grooved at 74 to receive the lobes 70 in the axially interlocking position.

Figure 5:
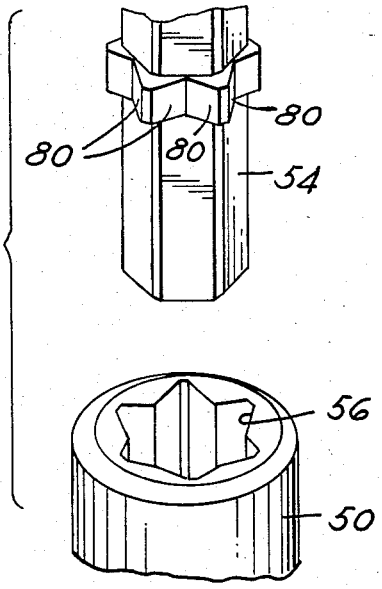
FIG. 5, an enlarged view of a hexagonal connection for a deep socket chuck.

In FIG. 5, the deep socket chuck 50 is illustrated with the receiving hexaploid cavity 56. The long drive shank 54 of starter driver 52 is shown with the lobes 80 which will enter the cavity 56 in one orientation and engage in undercut grooves within the chuck cavity 56 of chuck 50 upon relative rotation.

The lobes in each case are spaced axially from shoulders 38 toward the digital ends of the drive shanks and the undercut grooves are spaced inwardly from the bearings ends 39 of the recess an equal distance to register with the lobes in assembly.

In FIGS. 7 to 12 are illustrated various orientation views of a recessed part and received shank. The recessed part is shown with a round configuration, but this could be square or hexagonal, or any other polygonal shape. The word "polygonal" is used here to describe a multi-sided configuration with three or more sides.

In FIGS. 7, 8 and 9, a hexagonal shank 100 is shown within a hexaploid cavity of an outer part 120. In the central FIG. 7, the parts are shown in the load-unload position. The drive shank 100 has lobes 122. The cavity in the part has six radially inwardly extending axial ribs 124, but the dotted lines at these ribs show the undercut groove. In the position shown in FIG. 7, the shank 100 can move axially in or out of the cavity without interference.

In FIG. 8, the parts are shown in a counterclockwise drive position. The lobes **122*a* on part 100 are now in the undercut grooves so the parts 100 and 120 cannot be disengaged axially. This is termed a drive-lock position. Now looking at FIG. 9, a clockwise drive position is illustrated and the lobes 122*b* are now in the undercut grooves of the part 120. Again the parts 100 and 120** are in a reverse-lock position.

It will be appreciated that in either the drive- or reverse-lock positions, the parts are axially interlocked together. The inwardly projecting ribs 124 are in lineal contact with the hexagonal corners of the inner shank as at 130 in FIG. 8 or at 132 in FIG. 9 to effect the drive.

In FIGS. 10, 11 and 12 a similar series is illustrated in connection with a square shank and the quadaploidic cavity. An inner square shank member 140 is shown within an outer recessed member 160. The square shank has lobes 162 formed thereon. The quadaploid cavity in the outer part has four inwardly extending axial ribs 164 which, as shown by the dotted lines, are undercut. In the drive-lock position shown in FIG. 11, the lobes **162*a*** are moved into the undercut grooves so that the parts are in a drive-lock postion. At the same time, the ribs 164 are in lineal contact with the corners of the square shank 140 as at 166 to effect positive drive of the parts.

In FIG. 12, the reverse-lock position is shown in which the lobes 162*b* are now in the undercut grooves. The drive is now at the abutting parts 168 at the corners of the square shank.

When the roof bit operator is drilling, the rotative power will be operating usually in one directin with an upward force on the driver starter and the other drill steels in the line to the bit itself. Thus, the parts are usually in axial compression. In hard rock, the operator can switch from drive to reverse from time to time, without losing the various components.

When the hole has reached a desired depth, the line of driving steels must be drawn out of the hole. This too will be done with the parts rotating, but tension will be applied to withdraw the driving elements. The above described lock-drive system insures that the parts will be axially locked during withdrawal regardless of the direction of rotation. As the drilling line is withdrawn, the rotation may be stopped to allow piece-by-piece disassembly in the event there is a limited vertical clearance in which the operator is working.

It will be noted that each acircular drive shank, whether square or hexagonal, has multiple axially extending faces which terminate at a shoulder on the particular part whether it be a bit or a starter driver or an extension drive steel. This shoulder is spaced from the free or digital end of the shank and cooperates with the end of the wall of a recessed part which receives the smaller drive shank. Thus, the axial force on the drive rod assembly is transmitted through these shoulders at one end of a part and the peripheral wall surrounding the other end of a part. The locking lobes are spaced a predetermined distance from the shoulders and the undercuts in the recesses are spaced a similar distance into the recesses from the peripheral ends of the recesses.

I claim:

1. In a drill rod assembly for driving a mine bit, starter driver, drive extensions and the like, each having an acircular male drive with multiple axially extending faces to be received in a receiving acircular drive socket, (a) first means on a drive shank and on a receiving drive socket to limit the axial reception of a shank into a recess and carry axial load of said parts in operation, (b) one or more lobes extending radially from one or more of said faces spaced a predetermined distance from said first means on the insertion end of said drive shank, (c) said acircular drive socket having axially extending ribs circumferentially spaced around the receiving socket to accommodate the insertion of said drive shank and said one or more lobes, and one or more undercuts formed in said ribs a similar predetermined distance from the receiving end of the receiving socket, whereby upon insertion of said shank into a receiving socket relative rotation of said parts will move said one or more lobes into axial locking relationship with said one or more undercuts and move said axially entending faces of said shank into a rotative driving relationship with said ribs.

2. A drill rod assembly as defined in claim 1 in which said means on said drive shank and said means on said receiving socket to limit the axial reception of said parts comprises a radially extending shoulder on said drive shank spaced from the insertion end of a shank, and an annular wall at the end of each drive socket to contact said shoulder, said shoulder being positioned axially relative to said lobes to position said lobes in circumferential registry with said undercuts.

3. A drill rod assembly as defined in claim 1 in which said receiving socket is formed to accept a square driving shank in driving relationship.

4. A drill rod assembly as defined in claim 1 in which said receiving socket is formed to accept an hexagonal driving shank in driving relationship.

5. A drill rod assembly as defined in claim 1 in which said receiving socket has two or more undercuts in adjacent ribs whereby upon relative rotation of said parts in either direction of rotation selectively, clockwise or counterclockwise, said one or more lobes will move into axial locking relationship with one of said undercuts.

6. In a drill rod assembly for driving a mine bit, starter driver, drive extensions and the like, each having an acircular male drive with multiple extending faces to be received in a receiving acircular drive socket, (a) a drive shank on one part having multiple axially extending faces in a polygonal form with corners between the faces referred to as hexaploid or quadaploid, (b) radial lobes extending from said faces on at least one side of the corners, (c) a driven part having an axial recess in a polygonal shape in cross-section with axially extending ribs spaced around the recess to receive said lobed shank in a telescoping relationship and undercuts in said ribs spaced from the outer end of said recess to receive said lobes in a rotative drive relationship of said parts to axially interlock said parts, said corners of said shank contacting said ribs to impart a rotative driving relationship of said parts.

7. A drill rod assembly as defined in claim 6 in which lobes are extending from said faces on each side of said corners, and said ribs are equal in number to said corners, each of said ribs being undercut such that said lobes and said undercuts will register axially in either direction of relative rotation of said parts to provide a lock relationship.

* * * * *